US011427363B2

(12) United States Patent
Lutz et al.

(10) Patent No.: US 11,427,363 B2
(45) Date of Patent: Aug. 30, 2022

(54) PACKAGING SYSTEM AND METHOD FOR PRODUCING A PACKAGING

(71) Applicant: Multivac Sepp Haggenmüller SE & Co. KG, Wolfertschwenden (DE)

(72) Inventors: Florian Lutz, Lautrach (DE); Markus Wägele, Lautrach (DE)

(73) Assignee: MULTIVA SEPP HAGGENMUELLER SE & CO. KG, Wolfertschwenden (DE)

( * ) Notice: Subject to any disclaimer, the term of this patent is extended or adjusted under 35 U.S.C. 154(b) by 142 days.

(21) Appl. No.: 16/554,783

(22) Filed: Aug. 29, 2019

(65) Prior Publication Data

US 2020/0071011 A1 Mar. 5, 2020

(30) Foreign Application Priority Data

Aug. 30, 2018 (DE) ..... 10 2018 214 761.2

(51) Int. Cl.
*B65B 35/18* (2006.01)
*B65B 35/24* (2006.01)
(Continued)

(52) U.S. Cl.
CPC ..... *B65B 35/18* (2013.01); *B65B 35/24* (2013.01); *B65B 35/38* (2013.01); *B65B 47/02* (2013.01); *B65B 61/24* (2013.01); *B65B 2220/02* (2013.01)

(58) Field of Classification Search
None
See application file for complete search history.

(56) References Cited

U.S. PATENT DOCUMENTS 3,374,600 A * 3/1968 Rademacher ..... B65B 5/08 53/473
3,907,161 A 9/1975 Martin
(Continued)

FOREIGN PATENT DOCUMENTS

DE 1295342 A 5/1969
DE 3122021 A1 5/1982
(Continued)

OTHER PUBLICATIONS

European Search Report dated Jun. 9, 2020, Application No. 19188822.1-1016, Applicant Multivac Sepp Haggenmueller SE & Co. KG, 25 Pages.

*Primary Examiner* — Hemant Desai
*Assistant Examiner* — Tanzim Imam
(74) *Attorney, Agent, or Firm* — Brooks Kushman P.C.

(57) ABSTRACT

A packaging system having a packaging machine and a feeding device for the packaging machine. Packaging elements for receiving products in a predetermined format can be supplied to the packaging machine for a packaging process running thereon. The packaging machine may comprise a machine frame, at least one work station attached to the machine frame; a transport device that comprises a grouping unit for receiving packaging elements supplied by the feeding device to the packaging machine; and/or a transfer unit for transporting packaging elements received thereon to the work station. The grouping unit and the transfer unit can be brought together by way of a relative motion so that the packaging elements positioned on the grouping unit can be received by way of the transfer unit. The transfer unit may be capable of gripping the packaging elements. A method for producing a packaging as described above is also provided.

16 Claims, 10 Drawing Sheets

(51) Int. Cl.

| | |
|---|---|
| ***B65B 35/38*** | (2006.01) |
| ***B65B 47/02*** | (2006.01) |
| ***B65B 61/24*** | (2006.01) |

(56) References Cited

U.S. PATENT DOCUMENTS

| | | | | |
|---|---|---|---|---|
| 5,133,169 | A * | 7/1992 | Tesch, Jr. | B65B 5/068 53/247 |
| 6,021,629 | A | 2/2000 | Sterner, Sr. | |
| 6,623,236 | B1 | 9/2003 | Barnes | |
| 2006/0255201 | A1 | 11/2006 | Natterer | |
| 2011/0005171 | A1* | 1/2011 | Woerz | B65G 47/086 53/448 |
| 2011/0072764 | A1 | 3/2011 | Daniek et al. | |
| 2013/0152512 | A1* | 6/2013 | Sdahl | B65B 61/20 53/461 |
| 2015/0266602 | A1* | 9/2015 | Franceschi | B65G 47/90 414/222.01 |

FOREIGN PATENT DOCUMENTS

| | | | | |
|---|---|---|---|---|
| DE | 8705541 | U1 | 7/1987 | |
| DE | 102009031516 | A1 | 1/2011 | |
| EP | 1 714 874 | A1 | 10/2006 | |
| EP | 2 052 974 | A1 | 4/2009 | |
| EP | 2 133 272 | A1 | 12/2009 | |
| EP | 2665665 | B1 | 4/2018 | |
| GB | 2199559 | A * | 7/1988 | B65G 59/106 |
| WO | 2013004837 | A1 | 1/2013 | |
| WO | 2017001114 | A1 | 1/2017 | |
| WO | WO-2017001114 | A1 * | 1/2017 | B65B 9/04 |

* cited by examiner

PACKAGING SYSTEM AND METHOD FOR PRODUCING A PACKAGING

CROSS-REFERENCE TO RELATED APPLICATIONS

This Application claims priority to German Patent Application No. 10 2018 214 761.2 filed on Aug. 30, 2018 to Florian Lutz and Markus Wagele, currently pending, the entire disclosure of which is incorporated herein by reference.

FIELD OF THE INVENTION

The present invention relates to a packaging system that may include a packaging machine and a feeding device that supply packaging elements for receiving products in a predetermined format. The invention further relates to a method for transporting packaging elements along a packaging system.

BACKGROUND OF THE INVENTION

In known types of machines used in the technical field of the invention, a significant challenge is to accurately receive the trays that are fed to the machine for further processing, to transport them onward and to finally transfer them to a work station, for example, a thermoforming station of the packaging machine in a predetermined format.

Precise transfer to a thermoforming station means that thermoformed packaging trays produced therein can also be precisely combined with and connected to trays provided for this, in order to form a packaging lower part composed of different packaging materials for receiving a product, such as a food product, such as sausage, meat or cheese, provided along the downstream working stretch.

Multilayer packaging lower parts can then be produced along a packaging machine in a composite manner from tray parts made of different materials and they can have special packaging properties due to the use of different materials.

WO 2013/004837 A1 discloses a packaging machine according to the above purpose of application, where a transfer drum is used as a transfer element between a transport device and a film web to receive structural elements of the transport device and to place them beneath the film web. The transfer drum comprises a plurality of indentations at its surface, each of which can at least in part accommodate a structural element. The disadvantage of this is that the transfer drum takes up much space and transferring the trays is difficult to synchronize with the manufacturing process of the packaging machine.

WO 2017/001114 A1 also discloses a packaging machine that includes a suction unit for transferring structural elements to the packaging machine is used there. The suction unit suctions the structural elements provided to it on a bottom inner side. The disadvantage of this is that, for transporting the deeply formed structural elements, the suction unit also has to be formed to reach deep down to the bottom inner side of the structural element in order to suction the structural element at the bottom inner side. As a result, the suction unit itself occupies much space, especially for the transport of different tray formats, and further requires additional costly construction measures at the packaging machine, in particular at other units functionally connected to the suction unit. For example, the work station configured to receive and process the structural elements must have a large opening width, for which costly lifting mechanisms are needed. Furthermore, there is the risk that the structural elements still provided in a specific format to the suction unit slightly move out of their predetermined position due to the suction process when being received at the suction unit, which can cause undesired production inaccuracies in a downstream processing step. For suctioning the base of the packaging, the latter must also have a certain flat surface suitable for being suctioned, which limits the packaging to certain packaging formats.

In addition, the predetermined format of structural elements to be transferred to the work station is dependent upon the operation of the feeding device supplying the packaging machine with structural elements. This can slow down the overall production flow at the packaging machine. In particular, in WO 2017/001114 A1, the part of the feeding device projecting into the installation space of the packaging machine has influence upon the structural configuration of the packaging machine. Therefore, a certain structural dependency in technical terms is given because there is a restriction to certain types of machines and feeding devices.

SUMMARY OF THE INVENTION

The object of the invention is to provide a packaging system that is improved with respect to the above-described prior art and a corresponding method with which the manufacturing process can be realized in a precise, economical and versatile manner, especially overall by way of a compact configuration of the packaging system. Furthermore, the packaging system according to the invention is to be characterized by an increased cost-saving potential in its production over prior art.

The packaging system according to the invention comprises a packaging machine, which may be configured in the form of a thermoforming packaging machine, and a feeding device for the packaging machine, with which packaging elements for receiving products preferably in a predetermined format can be supplied to the packaging machine for a packaging process performed therewith.

The packaging elements supplied to the packaging machine by way of the feeding device can have any random shape, for example be flat or cup-shaped. The packaging elements are, in particular, made of a paper-like fibrous material, for example, made of cardboard, possibly made of coated cardboard, made of a metallic material, made of aluminum, made of foamed material such as Styrofoam, made of two-component material and/or made of another material, which is primarily suitable to form a packaging lower part in combination with film material.

The packaging machine used according to the invention comprises a machine frame, at least one work station that may be attached to the machine frame, and a transport device. The machine frame essentially defines an installation space of the packaging machine. Technical components of the packaging machine can be excellently attached to the machine frame.

The transport device of the packaging machine comprises a grouping unit for receiving the packaging elements supplied by way of the feeding device of the packaging machine as well as a transfer unit for transporting packaging elements received thereon to the work station. The transport device arranged at the packaging machine for transporting the packaging elements may be substantially composed of two transport units, namely the grouping unit and the transfer unit. The grouping unit can there be used advantageously as an extension of the feeding device, and as an independently operable transport device of the packaging machine. In particular, the grouping unit next to the feeding device can be controllable as a device for producing the predetermined transfer format of packaging elements for being received by way of the transfer unit. The separately controllable grouping unit can quasi compensate delays in the provision process of the packaging elements. Due to the quasi dually split transversal supply of packaging elements according to the invention, construction measures, in particular, according to prior art, that were structurally necessary according to prior art at the packaging machine in terms of the type-dependent end portion of the feeding device projecting thereinto, can be reduced to a minimum so that the constructive dependency described with respect to prior art is eliminated, at least to a significant degree.

According to the invention, the grouping unit and the transfer unit can be brought together by way of a relative motion such that the packaging elements preferably positioned in a predetermined format on the grouping unit can be received by way of the transfer unit.

The invention basically offers the advantage that the packaging elements transferred from the feeding device to the packaging machine can be provided within the installation space of the packaging machine precisely in a predetermined format, be transported onward according thereto and be transferred to the work station for further processing. All transport routes travelled by way of the transport device can be realized by way of compact units, without being dependent on a specific manufacturing format of the respective packaging elements.

Overall, the transport device can be integrated excellently into the machine frame of the packaging machine and is excellently suited according to the invention for use with different types of feeding devices.

In terms of configuration, the structural subdivision of the transport device into the grouping unit and the transfer unit results in an advantageous integral configuration on the packaging machine, which makes it easier to perform easily performable transport motions for continuously supplying the transported packaging elements to the work station for further processing.

The machine concept according to the invention offers an increased cost-saving potential in structural terms in the production process of the packaging machine in terms, which nevertheless results in a versatile standard setup which, however, can be easily adapted to certain circumstances.

The packaging system according to the invention is particularly suitable for transporting packaging elements which are designed as trays. Trays as used herein are packaging elements that each have a bowl-shaped body with an upper opening region.

According to one embodiment, the transfer unit comprises a suction plate for gripping the packaging elements. The suction plate is compact and ideally suited as a transport device in the machine frame of the packaging machine.

One embodiment of the invention provides that the suction plate comprises at least one reception mold which is adapted to engage at least in part in a positive-fit manner at the upper opening region of a tray and to suctionally engage the tray on an inner surface of at least one side wall of the tray by way of a vacuum applied to the suction plate, in order to transport the tray to the work station. As a result, the tray transport by way of the suction plate takes up little space within the packaging machine, resulting in a cost-effective design of the packaging machine in terms of its configuration.

According to one embodiment, the transfer unit further may comprise a linear drive with a guide attached to the machine frame of the packaging machine and a carriage, which is mounted thereonto adjustable in or opposite to a working direction of the packaging machine, and to which the suction plate is attached. This may ensure that the suction plate is mounted adjustable along the guide between a receiving position, in which packaging elements can be transferred to the suction plate by way of the grouping unit, and a transfer position, in which packaging elements transported by way of the suction plate can be transferred to the work station. With the aid of the linear drive, the suction plate can be adjusted in a compact manner within the machine frame. As such, the linear drive may have an inexpensive setup that can be easily mounted on the present machine frame of the packaging machine. A reversibly controlled adjustment motion of the suction plate can be precisely controlled by use of the linear drive and allows for high adjustment accelerations. In addition, the suction plate in the receiving position on the linear drive can be provided in a stably manner for receiving the packaging elements. The suction plate can be precisely adjusted to and fro at a predetermined height level by way of the linear drive. As a gripper positioned within the machine frame, the suction plate can therefore ensure tray delivery to the work station.

One variant of the invention may include that the grouping unit comprises a lifting mechanism and a conveyor belt mounted thereon in a height-adjustable manner. The conveyor belt mounted in a height-adjustable manner can preferably be adjusted vertically by way of the lifting mechanism in a translational manner within the machine frame of the packaging machine in order to move the conveyor belt by way of a lifting motion for passing the packaging elements positioned thereon onto the suction plate positionable thereabove. The conveyor belt as part of the grouping unit can be supplied directly with the packaging elements transported by way of the feeding device. Although it forms an independent transport unit of the transport device used on the packaging machine, the conveyor belt can therefore be used as an extension of the feeding device. The grouping unit is then overall available as an excellent link between the feeding device and the packaging machine.

The lifting motion on the grouping unit can be coordinated, in particular, together with an adjustment motion of the suction plate in such a way that a continuous production process can be controlled at the packaging machine. It is there also conceivable that respective motions of the grouping unit, in particular a stroke adjustment taking place there, and of the suction plate, in particular, horizontal displacement of the latter, take place in part in a temporally overlapping manner relative to each other, whereby manufacturing times are overall optimized.

In particular, the lifting motion on the grouping unit can be advantageously used to adjust certain formats of respective packaging elements in their orientation when transferred to the suction plate. It is conceivable that triangular-shaped trays are tilted with the lifting motion against the suction plate to a transport position in which they are attached to the suction plate and can be transferred by the latter to the work station. Therefore, a further application advantage arises in connection with the lifting mechanism which can be actuated in a height-adjustable manner.

It may be advantageous to have the grouping unit be attached integrally as a module in the machine frame of the packaging machine. In this embodiment variant, the grouping unit can be integrated completely within the machine frame of the packaging machine as a separate unit. According to the embodiment, the grouping unit forms an independent transport module within the machine frame of the packaging machine which is compatible with different types of feeding devices that supply packaging elements from outside the machine frame to the packaging machine.

It may be advantageous to have the transfer unit be attached integrally as a module in the machine frame of the packaging machine. This promotes an integrally formed compact configuration of the packaging machine. The packaging machine can then be setup without externally visible conversion measures despite its increased functionality.

According to one variant, the compact integral configuration of the packaging machine may be improved if the grouping unit and the transfer unit are positioned within the machine frame below a film transport device of the packaging machine, which runs along the working direction. From a functional perspective, this enables the parallel transport of various packaging materials toward the work station within the machine frame of the packaging machine, where the various packaging materials can be combined precisely at the work station for their further processing, in particular for the production of composite lower parts produced therefrom.

One variant of the embodiment provides that the packaging machine be a thermoforming packaging machine, where the work station is a forming station of the thermoforming packaging machine which can be supplied with packaging elements by way of the transfer unit, in particular by way of the suction plate, in a machine cycle for respectively being combined with film material provided at the forming station.

The feeding device preferably comprises a destacker for separating packaging elements stacked therein or a folding device for producing individual trays. In particular, such types of feeding devices can easily interact with the grouping unit provided at the packaging machine for transferring packaging elements or trays, respectively, preferably in a predetermined format to the grouping unit for onward transportation to the packaging machine.

It may be advantageous to have the feeding device comprise a transport section which is configured to arrange at least a portion of the packaging elements provided for the predetermined format, in particular packaging elements transported side by side in the direction of transport, with respect to the predetermined format and transfer them aligned accordingly to the grouping unit. For forming the predetermined format of packaging elements transported thereon, the transport section may be preferably provided with guide walls which are designed such that the packaging elements transported side by side along the transport section at the time of transfer to the grouping unit have a predetermined spacing transverse to their transport direction. The transport section of the feeding device can contribute to the creation of the predetermined format. The transport section can therefore at the packaging machine change an output format of the packaging elements that are output by the destacker or by the folding device with respect to the predetermined transport format.

According to one variant, the transport section comprises at least one chain with spacers which ensure that the packaging elements transported along the transport section maintain predetermined distances from one another in the transport direction. The transport section can therefore be used at least as a pre-positioner for transferring the packaging elements as accurately as possible to the grouping unit with regard to the predetermined transport format at the packaging machine. Nonetheless, the grouping unit can also advantageously contribute to the formation of the final format.

The packaging elements supplied to the packaging machine according to one variant have any randomly formed cup-shaped body and are made, in particular, of paper-like fibrous material, e.g. made of cardboard, made of a metallic material, e.g. made of aluminum, made of foamed material, e.g. made of Styrofoam, made of two-component material and/or made of another material, which may be suitable for this purpose to form a packaging lower part in combination with film material. However, the trays transported are preferably cardboard trays.

The suction plate may be preferably configured to transport packaging elements or trays in a predetermined transport plane. The suction plate may be extremely compact and can therefore be integrated into the machine frame of the packaging machine in a space-saving manner.

The suction plate preferably has at least one reception mold which may be formed at least in part having the shape of an inner contour of an upper opening region of a tray facing it, provided to the reception mold for reception and transport, so that the reception mold during transport of the tray may be at least in part arranged in a positive-fit manner in the transport plane in its upper opening region and aligns the tray in the transport plane in a predetermined position on the suction plate. It may be then possible to grip the provided trays only in their upper opening region, so that the suction plate can be formed to be compact throughout. It may be conceivable that the reception mold employed as a gripping device may be releasably attached as a removable component to the suction plate, so that the suction plate may be easily convertible with respect to different types of trays.

In the invention, the reception mold of the suction plate may be preferably formed as a negative vacuum mold with respect to the upper opening region of respective trays. The reception mold can then overall immerse in a positive-fit manner into the complementarily formed upper opening region of a tray provided thereto, so that the tray can be precisely positioned on the suction plate, be transported onward in a compact manner, and be delivered precisely to the work station. Due to the positive-fit and compact tray reception, large accelerations are possible for the suction plate, so that the packaging process can overall be conducted in a time-optimized manner.

In particular, the work station intended for further tray processing also benefits from the suction plate, because the suction plate as a plate-shaped member can be brought together with the work station in such a way that short lifting strokes are possible. This provides the possibility of a compact and cost-reducing configuration of the packaging machine. Comparable advantages also arise for the transport units that are employed to provide the trays for reception at the suction plate. Overall, the suction plate may be, therefore, greatly suitable as a plate-shaped transfer device within a compact machine space for transport between other functional units provided therein.

The trays transported by way of the suction plate can preferably be suctioned onto the suction plate in the predetermined position by a vacuum applied to the suction plate. For this variant, the reception mold can be configured to suction the tray on at least two, preferably opposite, inner sides of side walls formed therein. In one variant, several reception molds, for example in a 2×2, 2×3 or 3×3 format, are formed on the vacuum plate in order to transport several trays in this format by way of the vacuum plate with every conveying cycle. Depending on a current transport format of the trays from the reception mold formed on the suction plate, only predetermined reception molds can be connected to the vacuum in an automated and/or manual manner.

One embodiment of the invention provides that the reception mold comprises at least one bore which rests on an inner wall surface of the upper opening region during transport of the tray placed on the reception mold in the transport plane in a positive-fit manner, so that a vacuum applied to the suction plate suctions the tray via the bore of the reception mold by way of a predetermined holding force to secure the tray in the predetermined position.

It would be conceivable that the vacuum applied to the suction plate may be variable in order to applying holding forces of different strengths. A preferred variant in this context could provide that the vacuum and therefore the holding force generated may be automatically and/or manually adapted at the packaging machine with respect to a weight of the tray to be transported.

One embodiment of the invention provides that the reception mold comprises several bores which are formed on at least two oppositely disposed side walls of the reception mold for suctioning corresponding inner sides of the tray. The suction surface can thus be increased overall, whereby positionally accurate holding of the tray may be possible. This can also result in advantages for other working steps and/or test steps occurring at the suction plate, which shall be explained in more detail below.

A preferred variant provides that at least one bore may be formed on all side walls of the reception mold, so that the tray can be suctioned by way of the reception mold on all inner sides of side walls formed thereon. This has proven to be particularly advantageous when transporting larger trays which are used, for example, for packaging larger food products, for example, heavy cheese or meat portions.

For the variants described above, different cross-sections of the bore can be considered for the respective suction bores. The bore can have, for example, a circular, slot-like, wave-shaped and/or zigzag-shaped suction surface for suctioning the tray at its inner wall region. It would even be conceivable that the bore may be formed as a circumferential suction opening in the circumferential direction on the reception mold for suctioning the tray all around on the inner side in its upper opening region.

The reception mold may be preferably formed as a centering member with respect to the upper opening region of the tray. This means that the reception mold at least in part forms a geometrically tapered negative mold, which fits into the upper opening region of the tray and can be inserted into the supplied trays such that the tray may be centered thereon, meaning, a slight lateral displacement of the tray relative to the reception mold may be compensated. In particular, even high process speeds can be achieved therewith because the reception mold configured as a centering member can be positioned at least in part in a self-locking manner in the upper opening region of the tray, so that an optimal positive-fit connection for the onward transport may be given.

Preferably, at least two opposite side walls of the reception mold at least in part comprise a slanted side wall surface. When inserting the reception mold into the upper opening region of the tray provided to the reception mold, the tray can therewith be precisely centered on the reception mold, while a possible slight lateral offset can be compensated.

To reduce weight, the reception mold can be configured as a hollow member. It would be conceivable for the suction plate to be configured to perform a working step on the received tray via a cavity created at the reception mold, for example, pretreating the volume formed by the tray and connected to the cavity with a fluid.

The suction plate preferably comprises a folding device which may be adapted to form a sealing flange on a tray arranged on the reception mold along a preferably pre-perforated edge of the upper opening region. This can be done in particular when the tray is transported to the work station, so that the suction plate may be available both as a transport as well as a shaping module. The trays can therefore be supplied as semi-finished parts to the suction plate and be further formed thereat. The folding process can be performed without additional expense in time, i.e. during transport of the trays by way of the suction plate.

The reception mold may be preferably formed as part of the folding device. The reception mold therefore fulfills multiple functions at the suction plate according to the invention. The reception mold can preferably be used as a shaped abutment for the folding process, so that a precise sealing flange can be produced along the edge of the tray.

In particular, the suction plate can comprise an abutment edge along which the sealing flange can be bent. The abutment edge can there be formed on the suction plate such that it is aligned for the folding process toward the pre-perforated edge of the tray, in other words, abuts thereagainst, so that a precise fold arises for the sealing flange.

One variant of the invention provides that the folding device has a forming plate on which the reception mold may be adjustably mounted. The forming plate may be placed primarily above the reception mold. The forming plate and the reception mold can be moved relative to one another by way of a lifting motion in such a way that they enable producing the sealing flange on the attached tray of the reception mold. The reception mold can be movably mounted in particular on the forming plate between a position extended for receiving the tray and a position retracted for performing the folding operation.

The folding device can preferably be formed as an exchangeable module, which may be exchangeably attached to the suction plate. According to one embodiment, the exchangeable module comprises four reception molds which are attached in a 2×2 format to the forming plate.

One advantageous embodiment may be that the reception mold may be formed retractable at least in part into the forming plate. For this purpose, the forming plate can comprise a receptacle into which the reception mold can enter at least in part for the folding process.

For an improved folding process, the forming plate can comprise a forming groove on the circumference of the reception mold into which sections of the edge formed on the tray for the production of the sealing flange are guided during the folding process, so that the folding process can be precisely controlled.

One variant provides that the reception mold may be mounted on the forming plate in a spring-loaded manner. Preferably, at least one spring element may be provided between the forming plate and the reception mold to preload the reception mold to the extended position.

The folding device preferably comprises a movable lifting mechanism integrated into the suction plate. The lifting mechanism preferably comprises a controllable pressure element to move the reception mold for a folding operation toward the forming plate arranged thereabove. The tray placed on the reception mold can be pressed therewith against the forming plate for producing the sealing flange. The pressure element may be configured as an integral part of the suction plate and can be accommodated integrated therein, for example, as a controllable pressure diaphragm in order to coordinate the lifting motion of the reception mold relative to the forming plate.

The lifting mechanism preferably comprises at least one lifting element which may be mounted adjustable within the suction plate with the aid of the pressure element. According to the embodiment, the lifting element may be firmly coupled to the reception mold. The forming plate itself can be positioned as a rigid part of the suction plate between the reception mold arranged therebeneath and the lifting element arranged thereabove, wherein the pressure element in the pressure-loaded state against the forming plate therebeneath lifts away therefrom the lifting element arranged thereabove, so that the reception mold positioned on a side of the forming plate facing away from the pressure element may be adjusted toward to the forming plate for performing a folding process.

The lifting mechanism of the folding device may be preferably configured as a frame module which may be adjustably mounted movable on the suction plate relative to the forming plate positioned therebetween for performing the folding operation.

The suction plate can be equipped with at least one dynamic pressure test unit. It can be used to verify whether a tray may be properly placed onto the reception mold and/or whether a sealing flange has been properly formed on the tray. The dynamic pressure test unit may be formed preferably at least in part on the forming plate for checking the abutment of the tray, in particular its sealing flange.

According to one variant, the reception mold can be formed to be actively heated so that trays placed thereon are pretreated with heat at least in sections so that they can be better connected to another tray material, for example, a packaging film, in a downstream process. It would be conceivable to control the temperature by way of electromagnetic heating at the reception mold.

The suction plate preferably has a maximum installation height of 50 cm, preferably 30 cm, more preferably 10 cm. In such a compact plate-shaped installation configuration, it can be easily received and moved within the machine frame of the packaging machine.

Viewed in the working direction, the suction plate can be positioned upstream, downstream or laterally relative to the work station to be supplied with packaging elements or trays.

The invention also relates to a method for transporting packaging elements along a packaging system. According to the invention, packaging elements are first transported to a packaging machine by way of a feeding device. The transported packaging elements are preferably transferred at least in part, in particular those packaging elements that are transported in the direction of transport side by side, with respect to a predetermined format to a grouping unit of the packaging machine.

Furthermore, a relative motion may be performed between the grouping unit and a transfer unit of the packaging machine for transferring the packaging elements received at the grouping unit to the transfer unit. The packaging elements provided by way of the grouping unit are subsequently gripped by way of the transfer unit, in particular by way of a suction plate of the transfer unit, in order to transport the packaging elements to a work station of the packaging machine.

According to the invention, the transport flow of the packaging elements may be built up along the respective transport paths of the feeding device, the grouping unit and the transfer unit in order to transfer the packaging elements supplied to the packaging machine to the work station for further processing The method according to the invention can be realized with a structurally simple, compact and inexpensive configuration.

The packaging elements transported using the method according to the invention can be formed as trays, where the transfer unit, in particular a suction plate of the transfer unit, engages in a positive-fit manner with an upper opening region of the respective tray and the respective trays are suctioned on an inner wall surface of at least one side wall formed thereon. Such a plate-shaped receptacle of the respective trays by way of the suction plate allows for a compact integral structure of the transfer unit within the machine frame of the packaging machine and also provides structural advantages for the configuration of the work station, in particular with regard to an opening embodied thereon between a tool lower part and a tool upper part, because a small opening width thereon may be sufficient with regard to the suction plate.

According to one advantageous embodiment, the grouping unit may be adjusted in height relative to the transfer unit of the packaging machine by way of a lifting motion for transferring the packaging elements to the transfer unit. Height adjustment of the grouping unit performed by way of the lifting motion may be simple and inexpensive to perform and can be integrated excellently into the packaging machine. The lifting motion may be also advantageously controllable in view of respective adjustment motions of other transport devices, so that a continuous process can take place along the packaging system.

The packaging elements are preferably transferred from the feeding device to a conveyor belt of the grouping unit. The conveyor belt used in the grouping unit may be operable independently of a machine type of the feeding device. The conveyor belt can in particular also be integrated in a compact manner into the machine frame of the packaging machine and may be ideally suited within the machine frame of the packaging machine for interacting with the transfer unit that may be preferably also mounted therein.

With the invention, transporting the packaging elements at the packaging machine occurs by way of the modules of the grouping unit and the transfer unit, which are controlled independently of one another but can be coordinated with one another. This promotes the flexible use of the packaging machine according to the invention as part of the packaging system and the feeding device supplying the packaging machine with packaging elements. Furthermore, by way of the separately controllable grouping unit arranged specially disposed in the machine frame of the packaging machine, at least slight positioning inaccuracies within the format of the packaging elements transferred thereto can be corrected. For this purpose, the conveyor belt of the grouping unit could be actuatable to be reversible.

The method according to the invention may be optionally characterized in that the suction plate with a reception mold arranged thereon, which may be formed at least in part like the shape of an inner contour of an upper opening region of a tray provided to the reception mold for reception and transport, engages in the transport plane at least in part in a positive-fit manner in its upper opening region during transport of a tray transferred to the reception mold and aligns the tray in the transport plane in a predetermined position on the suction plate. According to the embodiment, the reception mold formed on the suction plate can be formed as a positive-fitting negative mold in terms of the upper opening region of the tray provided in order to immerse thereinto in a complementary manner.

When the tray is transported by way of the suction plate, a vacuum may be applied to the suction plate via at least one bore of the reception mold preferably suctions the tray at the upper opening region on the inner wall surface thereof by way of a predetermined holding force in order to secure the tray in the predetermined position.

One variant provides that a sealing flange on a tray positioned on the reception mold may be bent over by way of an adjustable folding device of the suction plate along a preferably pre-perforated edge of the upper opening region. Since this occurs in a preferred manner during the transport of the tray, a separate forming process can be dispensed with, so that the manufacturing process can overall be conducted in a time-optimized manner.

The folding process for producing the sealing flange on the suction plate may be preferably controlled by way of a pressurized lifting mechanism of the folding device integrated on the suction plate.

Verifying the presence of a tray on the reception mold and/or the proper production of a sealing flange on the tray can be done by way of at least one dynamic pressure test unit provided on the suction plate. It can be determined there from the presence of a predetermined dynamic pressure applied to the tray that the tray may be received in the predetermined position on the suction plate for transport and/or that the sealing flange produced by way of the folding device has been formed within tolerance limits.

The suction plate may be preferably used as a vacuum gripper, where trays are cyclically transported in or opposite to a working direction of the packaging machine from a receiving position in which the trays are transferred to the suction plate, to a transfer position in which the trays are transferred from the suction plate to the work station. Other aspects and advantages of the present invention will be apparent from the following detailed description of the preferred embodiments and the accompanying drawing figures.

DESCRIPTION OF THE SEVERAL VIEWS OF THE DRAWINGS

In the following, an advantageous embodiment of the present invention will be explained in more detail making reference to a drawing, in which the individual figures show.

DETAILED DESCRIPTION OF THE INVENTION

Figure 1A:
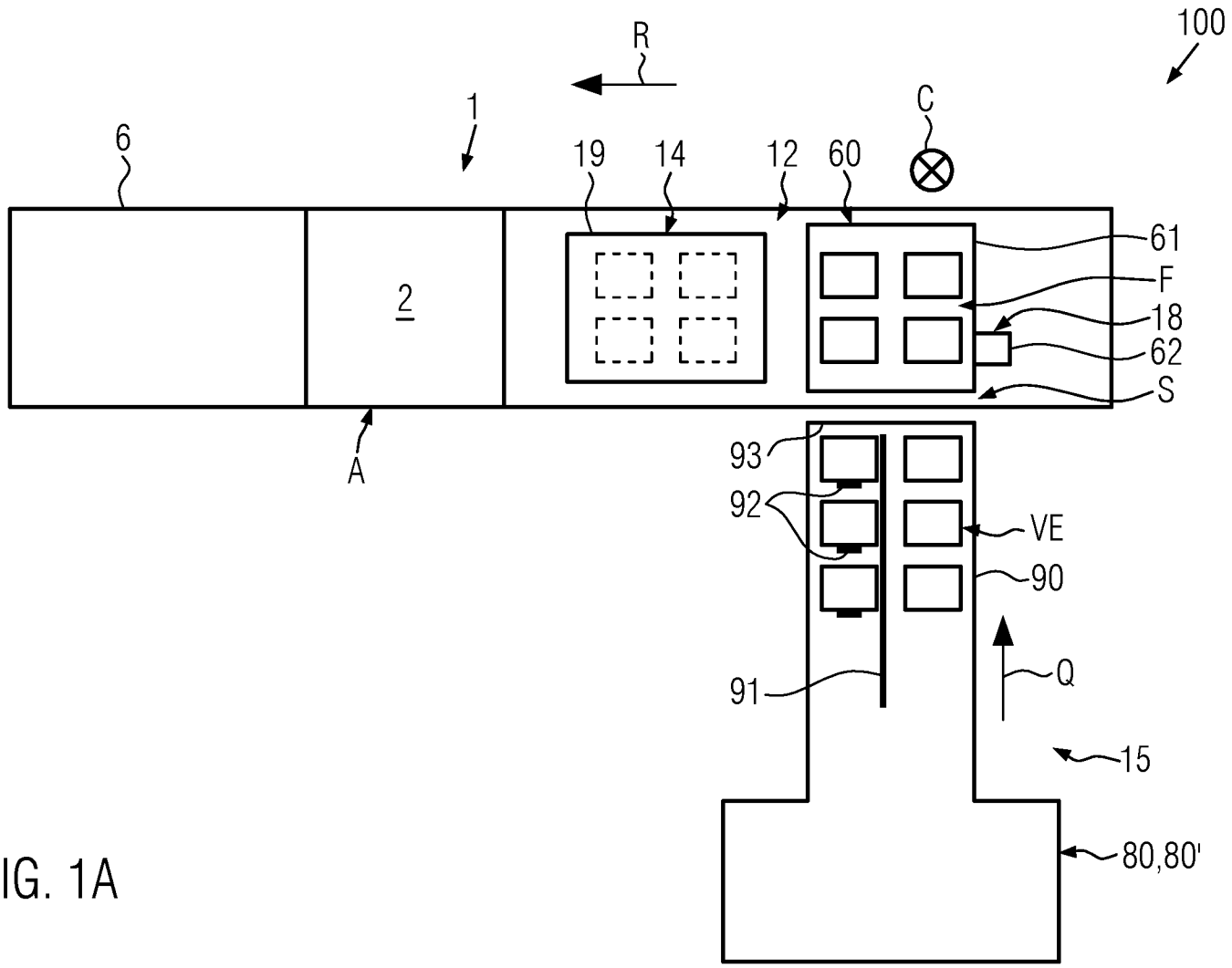
FIG. 1A is a schematic top view of one embodiment of a packaging system in accordance with the teachings of the present disclosure.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1A shows a packaging system 100 in a schematic top view. Packaging system 100 comprises a feeding device 15 and a packaging machine 1 which is supplied with packaging elements VE by feeding device 15.

Feeding device 15 comprises a destacker or a folding device 80 as well as a transport section 90 which is adapted to transport packaging elements VE to packaging machine 1. Transport section 90 comprises a guide plate 91 along which packaging elements VE can be guided to one end 93 of transport section 90 in a predetermined position.

Packaging machine 1 comprises a machine frame 6. Mounted within machine frame 6 is a transport device 12 for receiving and further transporting packaging elements VE transported by way of feeding device 15. Transport device 12 comprises a grouping unit 60 as well as a transfer unit 14.

Grouping unit 60 is functionally connected to feeding device 15 by way of a transfer gap S at end 93 of transport section 90. Transfer gap S is sized such that packaging elements VE can be easily transferred from transport section 90 to grouping unit 60. Grouping unit 60 comprises a conveyor belt 61 which is preferably configured to be reversible. Conveyor belt 61 can be operated together with transport section 90 or decoupled therefrom in direction of transport Q. In this case, respective packaging elements VE can be conveyed along direction of transport Q such that they are positioned at the latest on conveyor belt 61 in a predetermined format F, for example, the 2×2 format according to FIG. 1A. According to FIG. 1A, grouping unit 60 comprises a lifting mechanism 18 with a servomotor 62 which is designed to lift conveyor belt 61 along a lifting direction C directed out of the image plane.

Shown in the working direction R of packaging machine 1 is transfer unit 14 formed as a suction plate 19 next to grouping unit 60. Further in working direction R, a work station A is positioned next to suction plate 19. Work station A can be a forming station 2. Suction plate 19 can be positioned above grouping unit 60, so that packaging elements VE positioned on conveyor belt 61 can be raised to suction plate 19 disposed thereabove in the lifting direction C and gripped by way of suction plate 19. Suction plate 19 can then be released in working direction R, packaging elements VE received thereon can be transported to work station A and delivered to the latter such that they can be combined with a further packaging material provided at work station A.

Figure 1B:
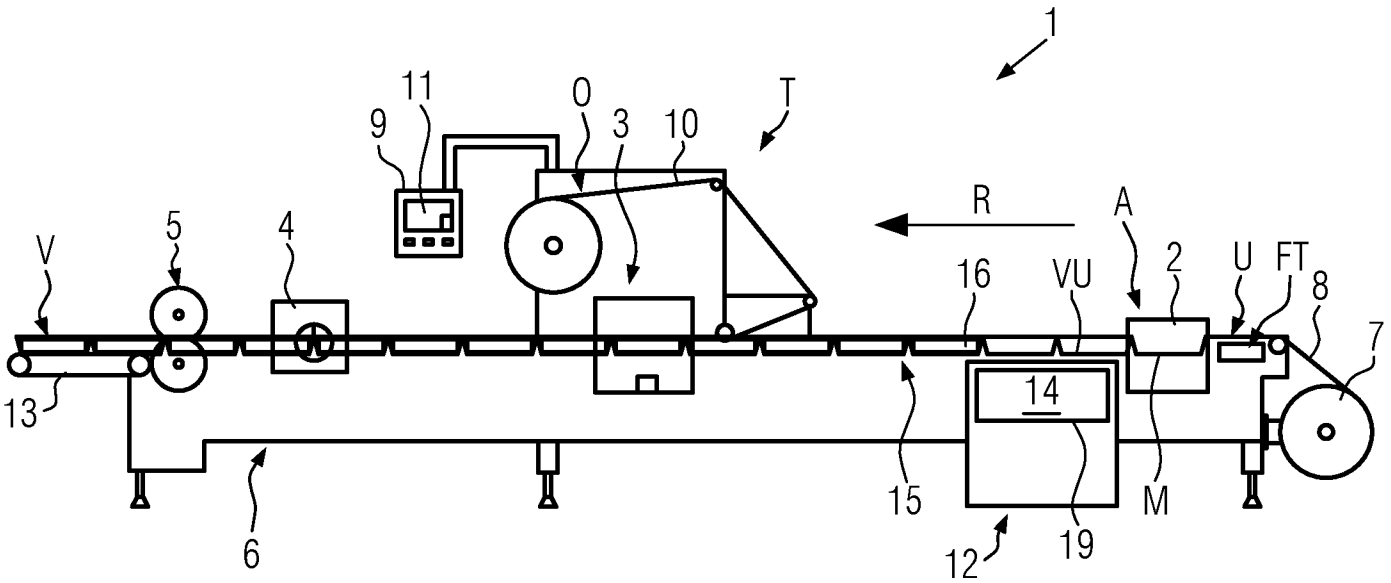
FIG. 1B is a schematic side view of one embodiment of a packaging machine in accordance with the present disclosure wherein the packaging machine is a thermoforming packaging machine.

FIG. 1B shows a schematic view of a packaging machine 1 in the form of a thermoforming packaging machine T. Packaging machine 1 comprises a work station 1 formed as a forming station 2, a sealing station 3, a transverse cutting device 4 as well as a longitudinal cutting device 5. They are arranged in this order along working direction R on machine frame 6.

Attached to machine frame 6 of packaging machine 1 on the inlet side is a feed roller from which a base film U as lower packaging material 8 is withdrawn. Base film U is transported into forming station 2 by a film transport device FT, shown only in part in FIG. 1B. 2 packaging trays M are formed into base film U using forming station 2 by way of a thermoforming operation taking place there. Packaging trays M can be transported onward to a loading stretch 15 where they can be filled manually or automatically with a product 16. Downstream of loading stretch 15, packaging trays M filled with products 16 are transported onward to a sealing station 3. Packaging trays M can be sealed by sealing station 3 with a top film O which forms an upper packaging material 10, so that sealing top film O onto packaging trays M produces sealed packages V which are separated by way of transverse cutting device 4 and longitudinal cutting device 5 and can be transported away using a discharge device 13.

Furthermore, packaging machine 1 shown in FIG. 1B comprises a controls terminal 9 at which process parameters can be set for the respective work stations provided at packaging machine 1. Controls terminal 9 comprises a control unit 11 which is shown only schematically. Control unit 11 is configured to perform computing operations, in particular in real time during the production process, in order to control packaging machine 1 based on processes, i.e. to possibly have respective process parameters of packaging machine 1 adjusted in relation to the process.

Packaging machine 1 illustrated in FIG. 1B further comprises a transport device 12 according to FIG. 1A associated with work station A, but which is positioned in the working direction R downstream of forming station 2, i.e. provides packaging elements VE by way of suction plate 19 in a direction opposite to working direction R of forming station 2.

FIGS. 1A and 1B illustrate, by way of example, that transport device 12 can transport packaging elements VE in or opposite to working direction R to forming station 2. Transport device 12 is configured to continuously supply packaging elements VE to forming station 2 during the manufacturing process which are combined with packaging trays M produced therein to create a (composite) packaging lower part VU.

Figure 2:
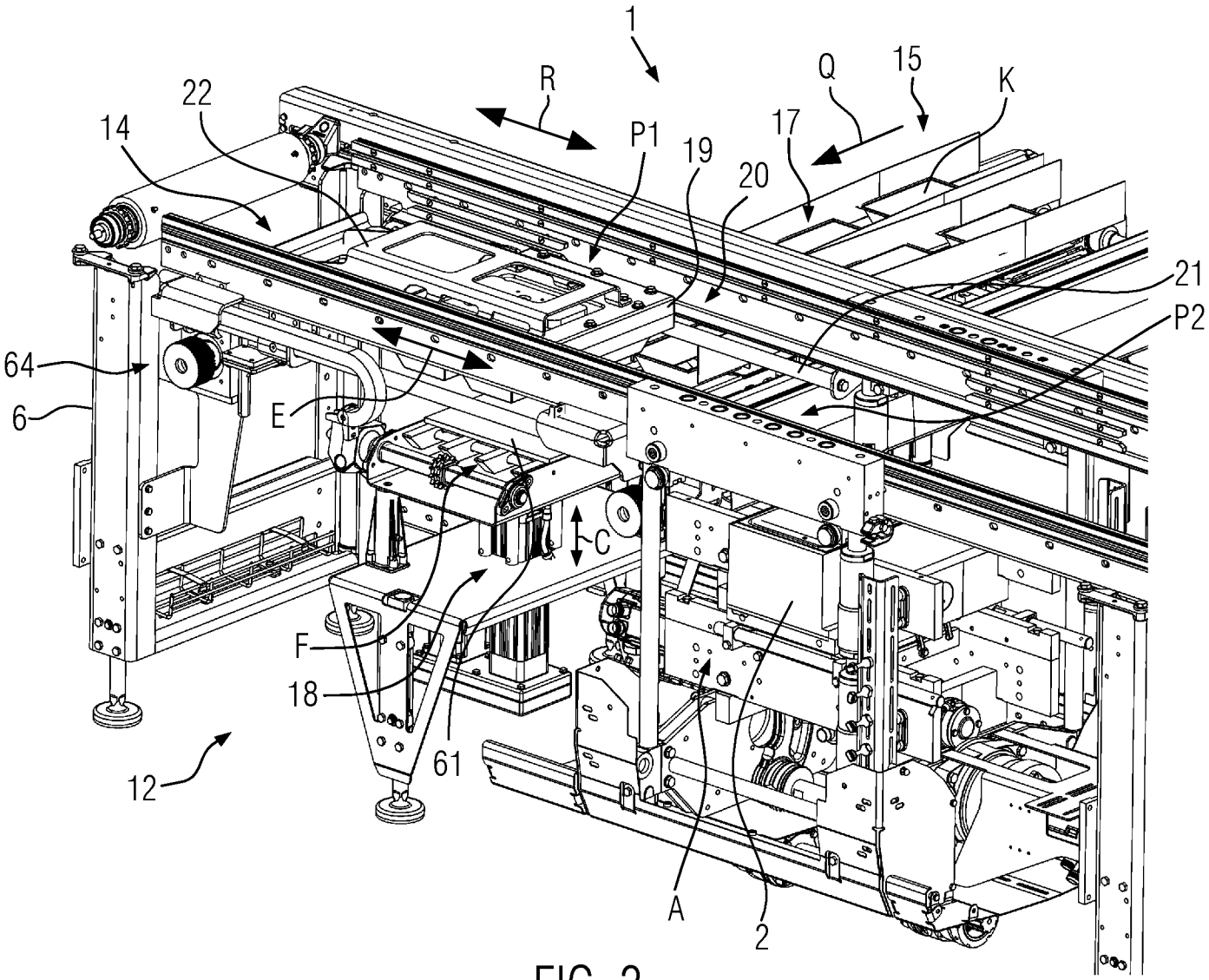
FIG. 2 is a perspective view of one embodiment of a detail of a packaging system in accordance with the present disclosure showing a grouping unit and a suction plate.

FIG. 2 shows a perspective view of transport device 12 integrated into machine frame 6 of packaging machine 1. According to FIG. 2, transport device 12 is transferred a plurality of trays 17 in a predetermined format F by feeding device 15, presently in a 2×2 format according to FIG. 1A, from outside machine frame 6 of packaging machine 1. Trays 17 in FIG. 2 are formed as cardboard trays K, but can also be made of a different material.

According to FIG. 2, trays 17 are transferred in the predetermined format F to grouping unit 60 arranged within machine frame 6, in particular to conveyor belt 61 provided there which is mounted vertically adjustable along lifting direction C by way of lifting mechanism 18. Lifting mechanism 18 is adapted to lift trays 17 positioned on conveyor belt 61 according to predetermined format F in lifting direction C for transferring trays 17 to transfer unit 14 positioned thereabove in a receiving position P1. Conveyor belt 61 can subsequently again be lowered back to its original position in which it can be transferred packaging elements VE by feeding device 15.

Transfer unit 14 shown in FIG. 2 is mounted adjustable in or opposite to working direction R of packaging machine 1 between receiving position P1, in which trays 17 can be transferred thereto, and a transfer position P2 along a transport plane E, in which trays 17 transported by transfer unit 14 can be transferred to forming station 2.

According to FIG. 2, transfer unit 14 is configured as a suction plate 19. Suction plate 19 is mounted adjustable between receiving position P1 and transfer position P2 by a linear drive 20 in or opposite to working direction R of packaging machine 1. Linear drive 20 is equipped with a guide 21 oriented in working direction R of packaging machine 1 on machine frame 6 and a carriage 22 that is displaceably mounted thereon and to which suction plate 19 is attached. Furthermore, an electric motor 64, e.g. a servo motor, adapted to control an adjustment motion of suction plate 19 is preferably attached to machine frame 6. The operation of electric motor 64 can be coordinated by control unit 11 of packaging machine 1.

The configuration shown in FIG. 2 shows that suction plate 19 as such is moved to and fro only horizontally in transport plane E for continuously supplying trays 17 received thereon to forming station 2 for further processing with packaging recesses M formed thereon.

Figure 3:
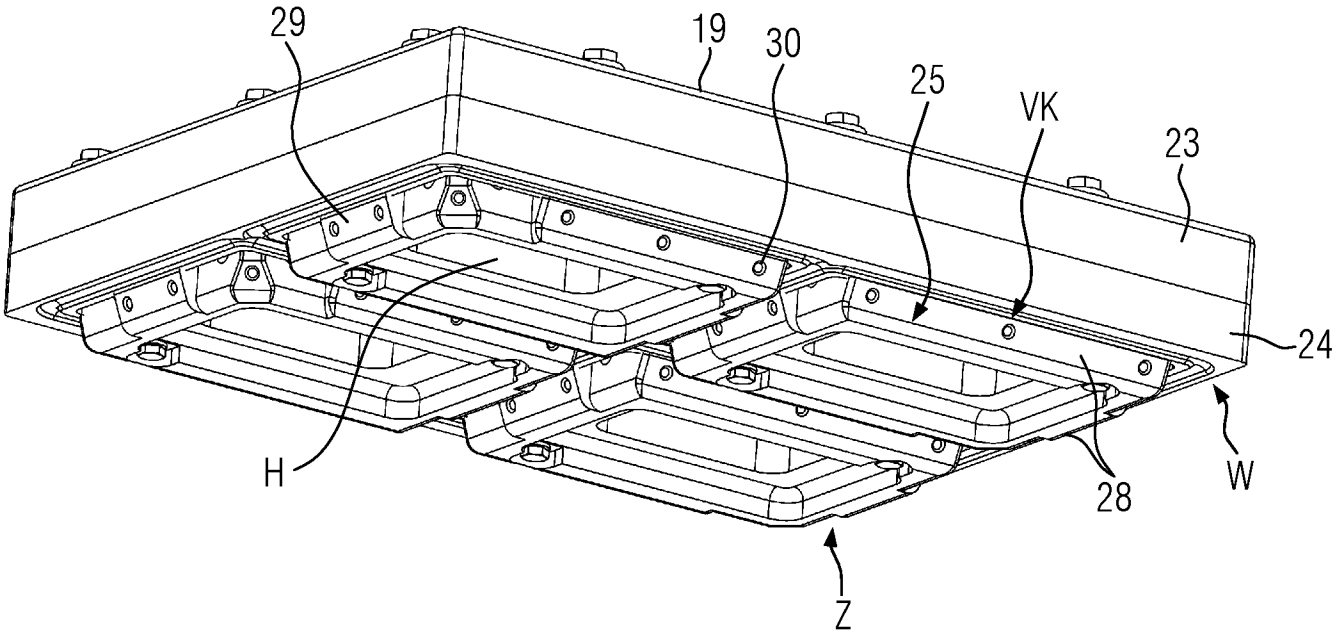
FIG. 3 is a perspective view of one embodiment of a suction plate according the teachings of the present disclosure.

FIG. 3 shows suction plate 19 according to one variant in an isolated view. Suction plate 19 shown in FIG. 3 comprises a plate-shaped upper part 23 with which suction plate 19 can be attached to carriage 22 (see FIG. 2). Furthermore, suction plate 19 comprises a plate-shaped center member 24 which is connected to upper part 23. Several reception molds 25 extend from center member 24 on a side facing away from upper part 23. Reception molds 25 are shaped in such a way that, with regard to trays 17 that are provided to them for transport, they can at least in part receive them as a negative mold in a positive-fit manner in their upper opening region 26.

Reception molds 25 can each be available separately or coupled to center member 24 as an exchange or retrofit attachment W for suction plate 19 in order to convert suction plate 19 for flexible use with respect to different tray geometries. Reception molds 25 shown in FIG. 3 are each configured in particular as hollow bodies H for reducing the weight of suction plate 19.

Figure 7:
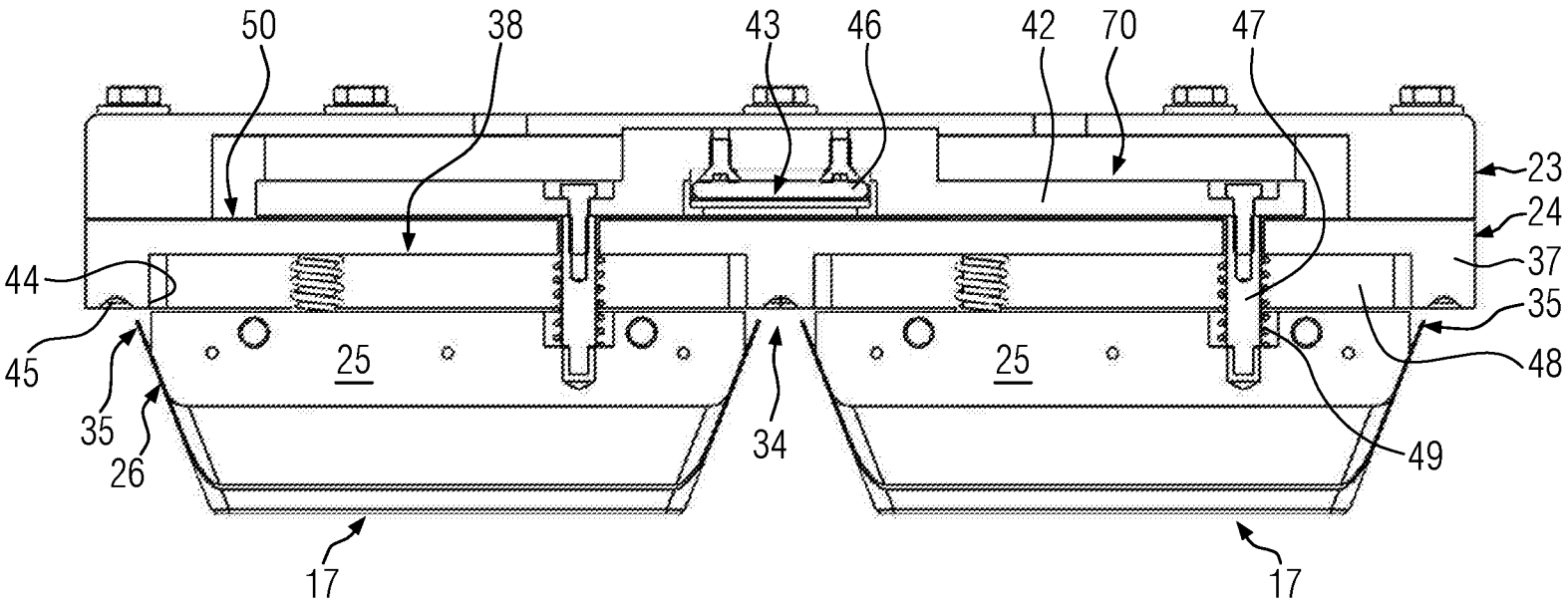
FIG. 7 is a sectional view of another embodiment of a suction plate in accordance with the teachings of the present disclosure having an unbent edge region and showing a folding device and a plurality of trays positioned thereon.
Figure 8:
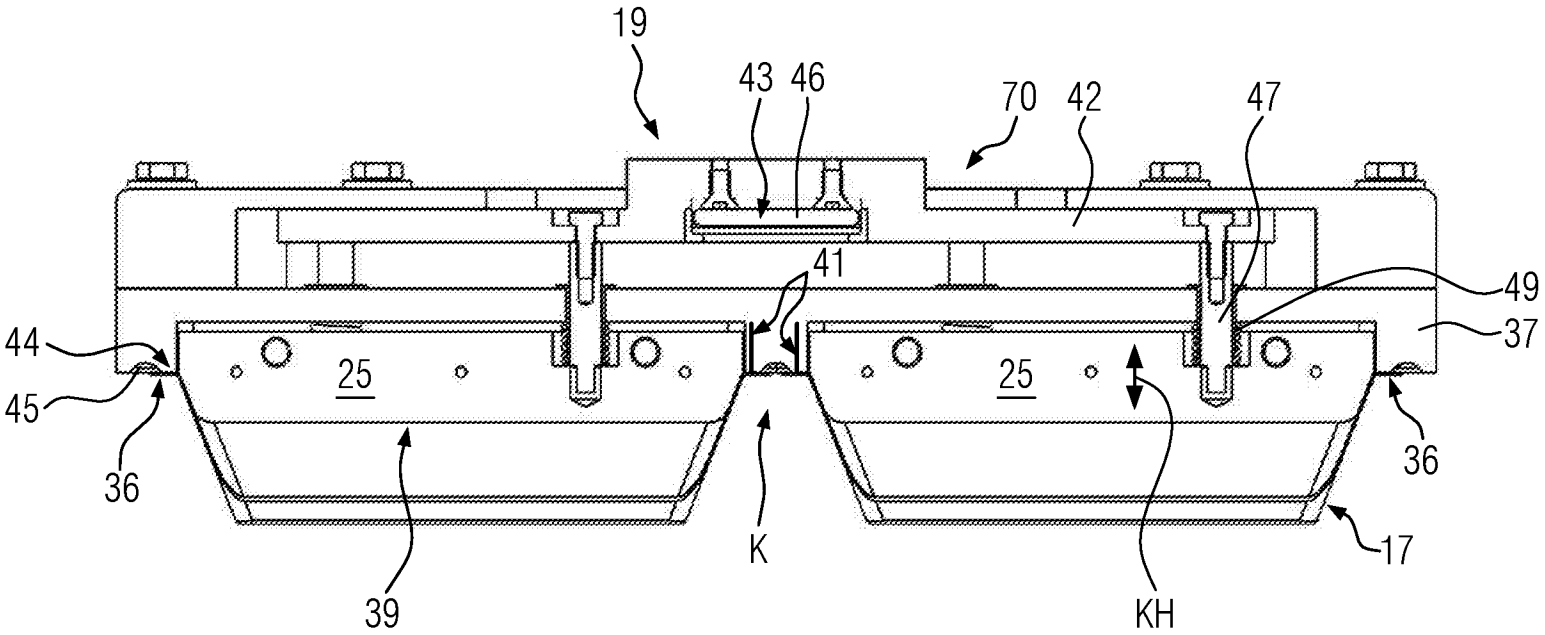
FIG. 8 is a sectional view of the suction plate from FIG. 7 having the edge bent showing a plurality of trays positioned thereon.

Reception molds 25 are configured according to FIG. 3, in particular, as centering members Z, in order to possibly compensate for a slight offset of supplied trays 17 when they are received at suction plate 19. Reception molds 25 designed in particular as centering members Z aim to ensure that trays 17 placed thereonto can be received in a precise position on suction plate 19, so that further work steps, apart from the actual transport purpose, for example, a folding operation K described in the context of FIG. 7 and FIG. 8, are promoted.

Furthermore, FIG. 3 shows that bores 30 are formed along respective side walls 28 of reception molds 25. During transport of trays 17 which are attached in a positive-fit manner on reception molds 25, respective bores 30 abut in sections against the former's inner wall surface 31 (see FIG. 4) of upper opening region 26, so that a vacuum VK applied to suction plate 19 via bores 30 of respective reception mold 25 suctions tray 17 attached thereto by way of a predetermined holding force P in order to align trays 17 in a predetermined position X (see FIG. 4) on suction plate 19, i.e. to transport them in the predetermined format F and transfer them to forming station 2.

Figure 4:
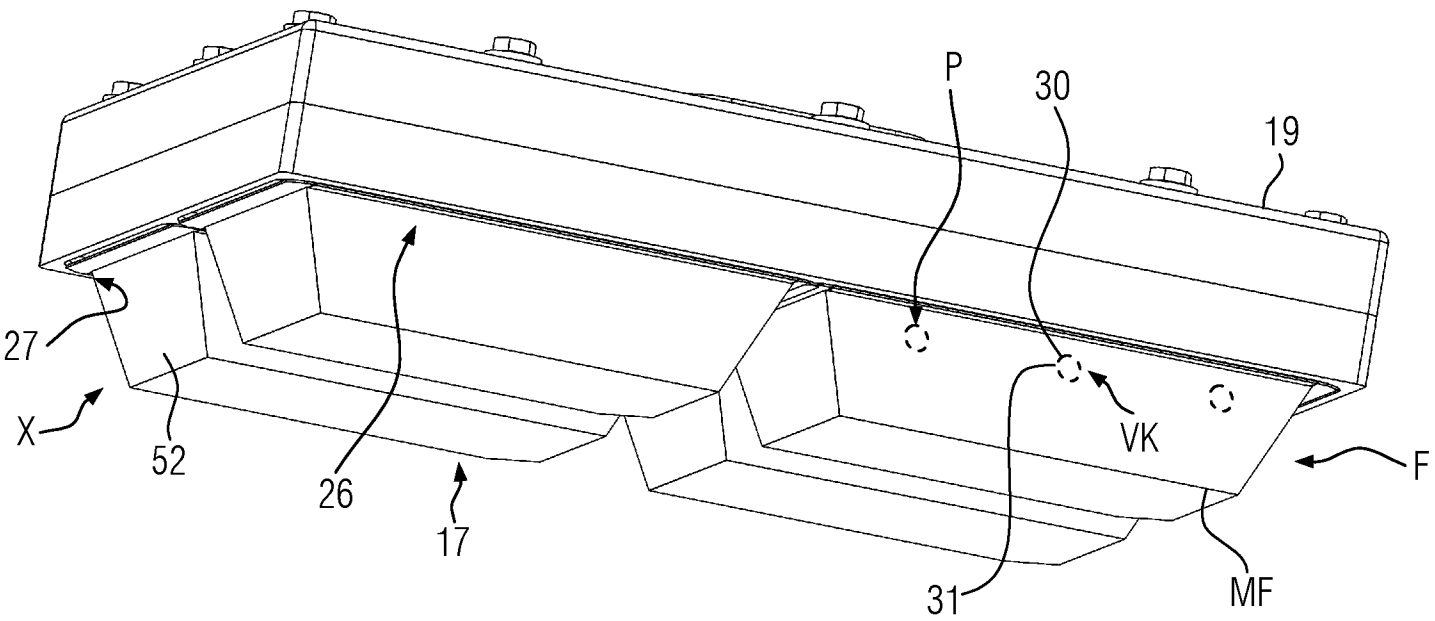
FIG. 4 is a perspective view of the suction plate of FIG. 3 with a plurality of trays positioned thereon.

FIG. 4 shows suction plate 19 from FIG. 3 with trays 17 received thereon in predetermined position X. According to FIG. 4, trays 17 received each have a bowl-shaped trough shape MF with an upper opening region 26 into which respective reception molds 25 immerse in a positive-fit manner.

Upper opening regions 26 formed on respective trays 17 have an inner contour 27 which corresponds at least substantially to the formation of respective side walls 28 of reception molds 25. According to FIG. 4, respective side walls 28 of reception molds 25, which are oriented towards the side of machine frame 6, are slanted so that they have a slanted suction surface 29 (see FIG. 3).

FIG. 4 also shows that respective trays 17 are received by suction plate 19 both in a positive-fit as well as in a force-fit manner. In this case, the positive-fit engagement is achieved by way of reception molds 25 produced as negative vacuum molds. The force-fit engagement for transporting trays 17 is supplied by vacuum VK applied to the respective inner wall surface 31 of trays 17.

Figure 5:
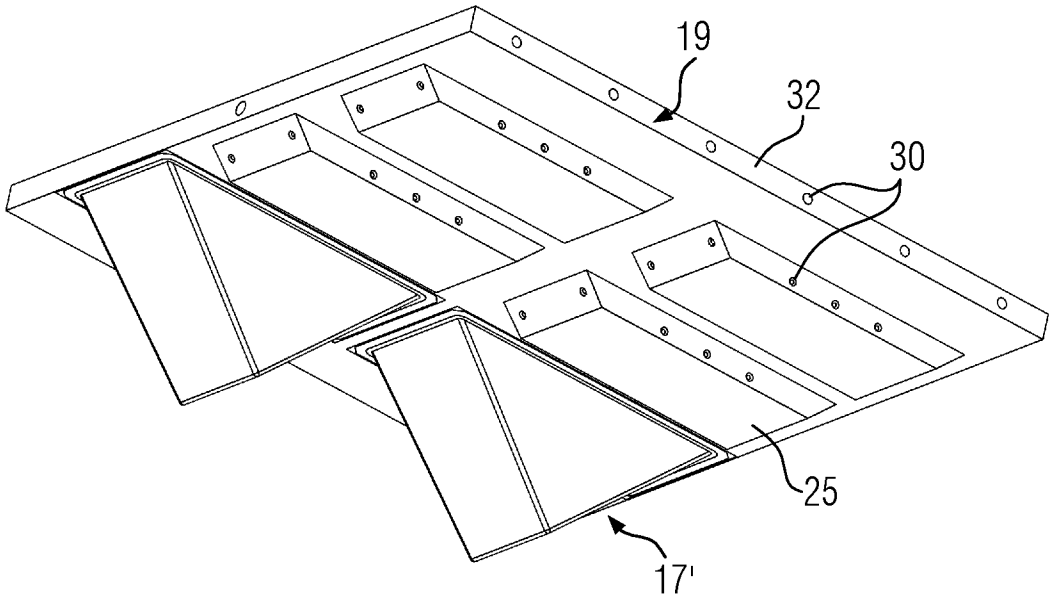
FIG. 5 is a perspective view of another embodiment of a suction plate in accordance with the teachings of the present disclosure.

FIG. 5 shows suction plate 19 according to another variant for transporting a format F of trays 17' that is different than is shown by way of suction plate 19 described in the context of the previous figures. According to FIG. 5, a total of nine wedge-shaped trays 17', which can be used, for example, for packing triangular slices, can be received at suction plate 19. Trays 17' are there transported by way of suction plate 19 in a 3×3 format.

The technical principle, according to which trays 17' can be secured to suction plate 19 both by positive-fit engagement at their upper opening region 26 and by force-fit engagement based on vacuum VK applied in this region, is also given in FIG. 5.

Formed in suction plate 19 of FIG. 5 is a plurality of bores 30 in a plate member 32 as well as in respective reception molds 25 to distribute vacuum VK applied to suction plate 19 for evenly securing trays 17'.

Figure 6:
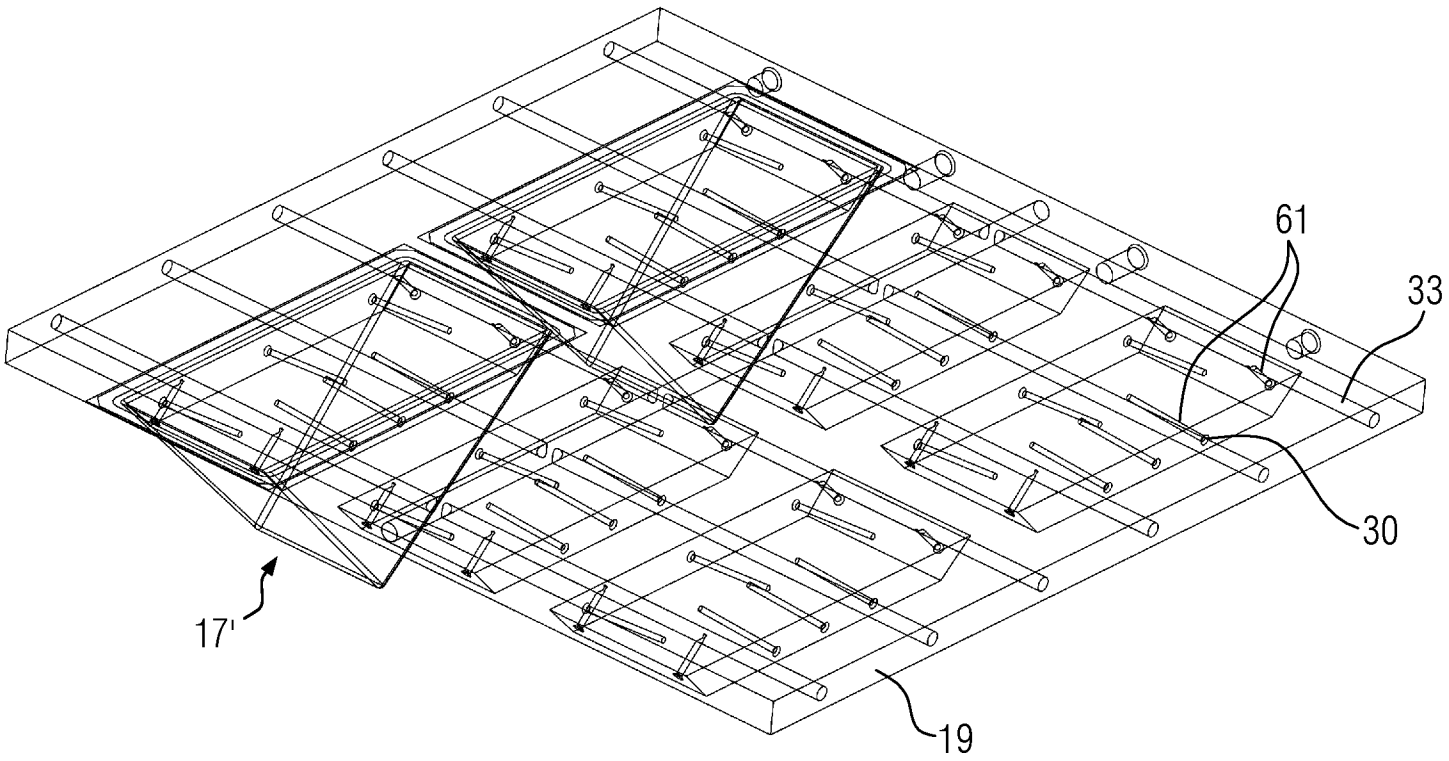
FIG. 6 is a perspective view of the suction plate from FIG. 5 showing trays positioned thereon in a transparent manner.

FIG. 6 shows several connection channels 33 formed in plate part 32 of suction plate 19 and respective connections 61 which deliver vacuum VK generated at suction plate 19 all the way to bores 30 formed on side walls 28 of reception molds 25. Vacuum VK applied via the respective connection channels 33 and/or connections 61 can be selectively directed and blocked at individual reception molds 25 by way of suitable valve control.

FIG. 7 shows suction plate 19 with folding device 34 formed integrally thereon. Folding device 34 comprises an adjustably mounted lifting mechanism 70 integrated into suction plate 19. Lifting mechanism 70 comprises a lifting element 42, for example, in the form of a plate which is arranged movable inside upper part 23 formed to be hollow in part and shown in FIG. 7, and a pressure element 34 arranged therebelow which is present in particular in the form of an inflatable membrane 46.

Lifting element 42 is connected by way of connection pins 47 to reception molds 25. Connection pins 47 pass through a forming plate 37 of folding device 34 embodied for a folding process K (see FIG. 8). Lifting element 42, which is positioned above forming plate 37, and reception molds 25, which are attached to lifting element 42 by way of connection pins 47 and positioned on a side of forming plate 37 facing away, form a functionally coherent module of folding device 34.

In the pressure-loaded state, membrane 46 raises lifting element 42 upwardly away from forming plate 37. As a result, reception molds 25 coupled thereto for folding process K are raised at the same time for producing a sealing flange 36 (see FIG. 8) on trays 17 placed thereon. In the unpressurized state, lifting element 42 rests on an upper side 50 of forming plate 37. Reception molds 25 are accordingly in an extended position 38 shown in FIG. 7. In this position 38, reception molds 25 are positioned spring-loaded by way of respective spring elements 49. The jointly acting spring rate of respective spring elements 49 can be matched to the pressure-loaded operation of membrane 46 in such a way that a predetermined folding stroke KH indicated in FIG. 8 is obtained.

According to FIG. 7 and FIG. 8, the sealing flange 36 is formed for respective trays 17, which are arranged on reception molds 25, along an edge 35 of respective upper opening region 26 formed thereon.

For the production of respective sealing flanges 36, reception molds 25 can be at least in part retracted at forming plate 37 disposed thereabove into receptacles 48 formed thereon in order to draw trays 17 arranged thereon toward forming plate 37.

FIG. 8 shows that trays 17 arranged on reception molds 25 are deformed along their edge 35 by folding stroke KH, as a result of which sealing flange 36 is formed on respective trays 17.

Suction plate 19 shown in FIG. 7 holds reception molds 25 arranged thereon in a spring-loaded manner in extended position 38, in which trays 17 are transferred without sealing flange 36 formed thereon to the suction plate 19. FIG. 8 shows respective reception molds 25 in a retracted position 39, in which reception molds 25 are drawn into corresponding receptacles 48 of forming plate 37 disposed thereabove by way of the lifting mechanism 70 which is now pressure-loaded against the spring preload. By immersing respective reception molds 25 into receptacles 48 of forming plate 37 provided for this purpose, folded edge 35 shown in FIG. 7 is deformed in such a way that respective sealing flanges 36 shown in FIG. 8 are produced on trays 17.

According to FIG. 7 and FIG. 8, bending grooves 45 are formed on forming plate 37 that are adjacent to respective receptacles 48 and support the folding process K of sealing flanges 36. A circumferentially formed abutment edge 44 formed at respective receptacles 48 also has a positive effect for the creation of a precise sealing flange 36.

Furthermore, FIGS. 7 and 8 show that suction plate 19 shown therein also has a dynamic pressure test unit 41. Dynamic pressure test unit 41 is formed on forming plate 37 in such a way that it can be verified in particular whether a tray 17 is properly positioned on suction plate 19 for a transfer process to work station A. It can also be verified by way of the dynamic pressure test unit 41 whether sealing flange 36 has been folded within tolerance limits.

Figure 9:
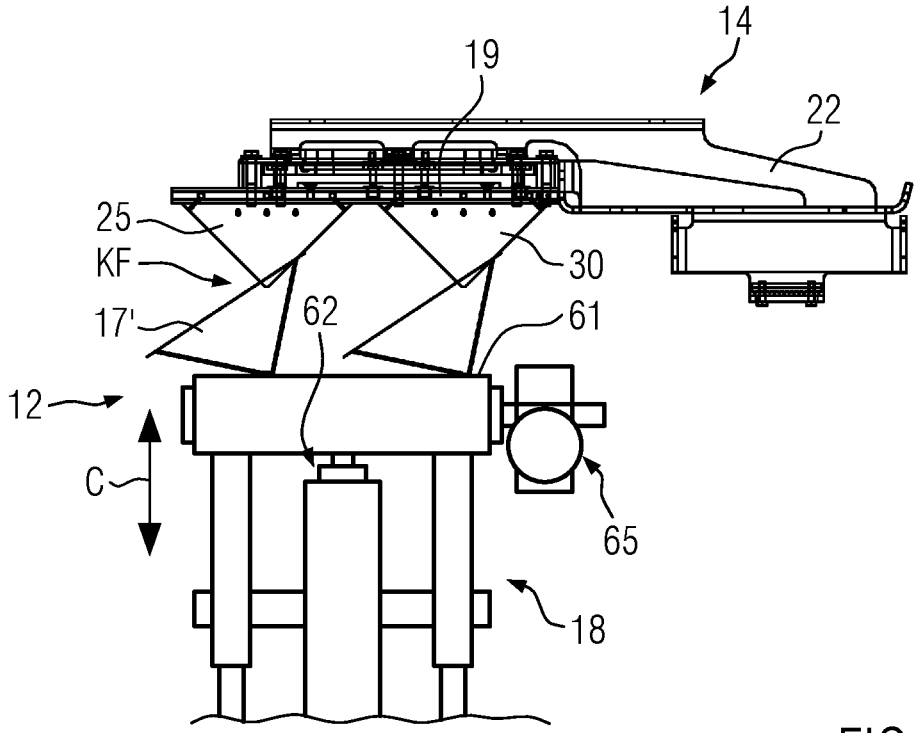
FIG. 9 is a schematic end view of one embodiment of a transport device in accordance with the teachings of the present disclosure wherein the transport device includes a height-adjustable grouping unit at a first setting.
Figure 10:
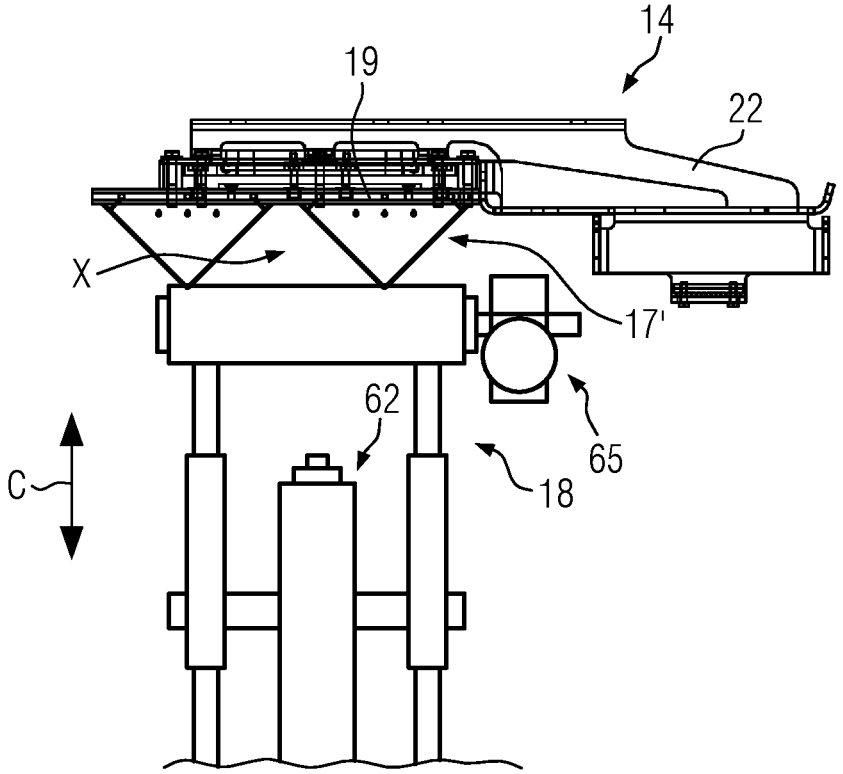
FIG. 10 is a schematic end view of the transport device of FIG. 9 at a second setting.

FIG. 9 shows transport device 12 in a side view, where suction plate 19 is used as a tilting guide KF, in addition to its previous function explained in the context of the invention. Trays 17 raised by way of lifting mechanism 18 in lifting direction C are there tilted during the lifting process toward suction plate 19 by way of reception molds 25 formed thereon until trays 17' assume the predetermined position X shown in FIG. 10 at suction plate 19. For this purpose, the lifting motion along lifting direction C can be adapted in accordance with the tray geometry. FIGS. 9 and 10 further show a servo motor 65 which is provided for the operation of conveyor belt 61 on lifting mechanism 18.

Transport device 12 employed in the invention, including suction plate 19 employed according to the invention, can be used at different locations along packaging machine 1 for supplying respective trays 17 that are fed to packaging machine 1 from outside for a further processing process performed thereon, for example, for combining with packaging trays M thermoformed at forming station 2. In particular, transport device 12 can be positioned in working direction R of packaging machine 1 of FIG. 1 upstream or downstream of forming station 2 configured as work station A, for producing trays 17 corresponding to packaging trays M produced thereon for producing packaging lower parts VU combined from trays 17 and packaging trays M. (see FIG. 1B). Respective packaging lower parts VU produced in forming station 2 are then transported onward quasi as a tray composite to loading stretch 15.

Transport device 12 used in the invention is not restricted to the use at a thermoforming packaging machine T according to FIG. 1, but can also be used in an advantageous manner at other types of machines, such as tray sealers.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A packaging system comprising:

a packaging machine and a feeding device for the packaging machine, wherein the feeding device is capable of supplying packaging elements for receiving products in a predetermined format to the packaging machine;

wherein the packaging machine comprises a machine frame, at least one work station, a transport device, and a transfer unit capable of transporting packaging elements received thereon to the at least one work station, wherein the transport device comprises a grouping unit capable of receiving the packaging elements supplied by the feeding device to the packaging machine;

wherein the grouping unit and the transfer unit are disposed for relative movement and capable of being brought together by way of a relative motion such that the packaging elements positioned on the grouping unit can be received using the transfer unit;

wherein the transfer unit is capable of gripping the packaging elements; and wherein the grouping unit comprises a lifting mechanism and a conveyor belt that is mounted to be adjustable in height using the lifting mechanism.

2. The packaging system according to claim 1, wherein the transfer unit comprises a suction plate.

3. The packaging system according to claim 2, wherein the packaging elements are a plurality of trays and the suction plate comprises at least one reception mold that is adapted to engage with an upper opening region of a tray in a positive-fit manner and to firmly suction the tray on an inner contour of the upper opening region of the tray using a vacuum applied to the suction plate such that the suction plate is capable of transporting the plurality of trays to the at least one work station.

4. The packaging system according to claim 2, wherein the transfer unit further comprises a linear drive with a guide attached to the machine frame of the packaging machine and a carriage that is mounted on the guide and is adjustable in or opposite to a working direction of the packaging machine, and wherein the suction plate is attached to the carriage so that the suction plate is mounted adjustable along the guide between a receiving position, in which packaging elements can be transferred to the suction plate, and a transfer position, in which packaging elements transported by way of the suction plate can be transferred to the at least one work station.

5. The packaging system according to claim 1, wherein the grouping unit is attached as a module integrated into the machine frame of the packaging machine.

6. The packaging system according to claim 1, wherein the transfer unit is attached as a module integrated into the machine frame of the packaging machine.

7. The packaging system according to claim 1, wherein the grouping unit and the transfer unit are positioned within the machine frame beneath a film transport unit of the packaging machine extending in a working direction.

8. The packaging system according to claim 1, wherein the packaging machine is a thermoforming packaging machine, and wherein the at least one work station comprises a forming station of the thermoforming packaging machine that can be supplied with packaging elements using the transfer unit in a machine cycle for combining the packaging elements with a film.

9. The packaging system according to claim 1, wherein the feeding device comprises one of a destacker for separating packaging elements stacked therein, or a folding device for producing individual cardboard trays.

10. The packaging system according to claim 1, wherein the feeding device comprises a transport section that is capable of transferring at least a portion of the packaging elements provided for the predetermined format to the grouping unit.

11. The packaging system according to claim 1, wherein the conveyor belt of the grouping unit is spaced apart from the feeding device.

12. The packaging machine according to claim 1, wherein the feeding device comprises a transport section that can be operated together with the conveyor belt of the grouping unit to transport packaging elements in a direction of transport, and the conveyor belt can be decoupled from the transport section.

13. The packaging system according to claim 1, wherein the conveyor belt of the grouping unit is adjustable in height relative to the feeding device.

14. The packaging system according to claim 1, wherein the grouping unit is mounted within the machine frame, and the feeding device is positioned outside of the machine frame.

15. A packaging system comprising:

a packaging machine and a feeding device for the packaging machine, wherein the feeding device is configured to supply packaging elements for receiving products in a predetermined format to the packaging machine;

wherein the packaging machine comprises a work station, a transport device, and a transfer unit configured to transport packaging elements received thereon to the work station, wherein the transport device comprises a grouping unit configured to receive the packaging elements supplied by the feeding device to the packaging machine;

wherein the grouping unit comprises a conveyor belt that is adjustable in height relative to the feeding device and the transfer unit, so that the packaging elements positioned on the grouping unit can be received using the transfer unit; and wherein the transfer unit is configured to grip the packaging elements.

16. The packaging system according to claim 15, wherein the packaging machine comprises a machine frame, the grouping unit and the transfer unit are mounted within the machine frame, the feeding device comprises a transport section that is movable in a direction of transport toward the grouping unit, and the transfer unit is movable within the machine frame in a direction transverse to the direction of transport to transport the packaging elements received thereon to the work station.

* * * * *